US009022549B2

(12) United States Patent
Sawada

(10) Patent No.: US 9,022,549 B2
(45) Date of Patent: May 5, 2015

(54) PRINTING APPARATUS AND PRINTING METHOD THEREFOR

(75) Inventor: Keishi Sawada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 134 days.

(21) Appl. No.: 13/230,778

(22) Filed: Sep. 12, 2011

(65) Prior Publication Data

US 2012/0062677 A1 Mar. 15, 2012

(30) Foreign Application Priority Data

Sep. 14, 2010 (JP) ..... 2010-205746

(51) Int. Cl.

| | |
|---|---|
| ***B41J 2/01*** | (2006.01) |
| ***B41J 11/70*** | (2006.01) |
| ***B41J 2/175*** | (2006.01) |
| ***B41J 29/17*** | (2006.01) |
| ***B41J 29/38*** | (2006.01) |

(52) U.S. Cl.

CPC *B41J 11/70* (2013.01); *B41J 2/175* (2013.01); *B41J 29/17* (2013.01); *B41J 29/38* (2013.01)

(58) Field of Classification Search

USPC ..... 347/104, 101, 16, 102, 157

See application file for complete search history.

(56) References Cited

U.S. PATENT DOCUMENTS

| | | | | |
|---|---|---|---|---|
| 2,980,933 | A * | 4/1961 | Schwartz et al. | 15/1.51 |
| 4,375,189 | A * | 3/1983 | Berner et al. | 101/68 |
| 4,662,255 | A * | 5/1987 | Toon | 83/104 |
| 4,878,657 | A * | 11/1989 | Ura et al. | 271/9.13 |
| 4,967,285 | A * | 10/1990 | Tabuchi | 358/304 |
| 5,041,864 | A * | 8/1991 | Saito et al. | 355/29 |
| 5,172,238 | A * | 12/1992 | Kuboki | 358/296 |
| 5,223,940 | A * | 6/1993 | Matsumoto | 358/304 |
| 5,413,426 | A * | 5/1995 | Ijuin et al. | 400/621 |
| 5,481,291 | A * | 1/1996 | Ishida et al. | 347/217 |
| 5,579,042 | A * | 11/1996 | Ishida et al. | 347/217 |
| 5,743,663 | A * | 4/1998 | Imai | 400/120.04 |
| 5,838,354 | A | 11/1998 | Yamada et al. | |
| 7,484,722 | B2 * | 2/2009 | Ishii | 271/9.09 |
| 8,141,976 | B2 * | 3/2012 | Motoyama et al. | 347/19 |
| 2001/0004284 | A1 * | 6/2001 | Fukuda et al. | 355/29 |
| 2003/0052953 | A1 * | 3/2003 | Sai | 347/104 |
| 2004/0041334 | A1 * | 3/2004 | Yoshihara | 271/145 |
| 2004/0096253 | A1 * | 5/2004 | Ueno et al. | 399/385 |

(Continued)

FOREIGN PATENT DOCUMENTS

| | | |
|---|---|---|
| JP | 4118262 | 4/1992 |
| JP | 4360454 | 12/1992 |

(Continued)

*Primary Examiner* — Julian Huffman
*Assistant Examiner* — Leonard S Liang
(74) *Attorney, Agent, or Firm* — Workman Nydegger

(57) ABSTRACT

A printing apparatus includes: a transporting unit that transports a printing medium; a printing unit that performs a printing process on the printing medium, which is transported forward from an upstream side to a downstream side by the transporting unit, at a print position in a transport path; a cutting unit that cuts the printing medium at a cutting position on the downstream side of the print position so as to divide a part of the printing medium, on which the printing process is performed, from a non-printed part thereof on the upstream side of the part; and a removing unit that removes cutting dust. The printing unit performs the printing process on the non-printed part thereof from which the cutting dust is removed through the removing unit by transporting the printing medium backward to the print position.

11 Claims, 10 Drawing Sheets

(56) References Cited

U.S. PATENT DOCUMENTS

| | | | | |
|---|---|---|---|---|
| 2005/0018029 | A1* | 1/2005 | Takagi et al. | 347/104 |
| 2005/0258590 | A1* | 11/2005 | Nishimura | 271/225 |
| 2008/0080915 | A1* | 4/2008 | Ito | 399/361 |
| 2009/0160120 | A1* | 6/2009 | Hirose | 271/18 |
| 2010/0183351 | A1* | 7/2010 | Uji et al. | 399/400 |
| 2011/0025755 | A1* | 2/2011 | Rosati et al. | 347/29 |
| 2011/0150553 | A1* | 6/2011 | Akatsuka et al. | 400/611 |
| 2011/0204559 | A1* | 8/2011 | Takamatsu | 271/18.1 |

FOREIGN PATENT DOCUMENTS

| | | | |
|---|---|---|---|
| JP | 04360454 | A * | 12/1992 |
| JP | 11-208918 | | 8/1999 |
| JP | 2003039757 | | 2/2003 |
| JP | 2007-008701 | | 1/2007 |
| JP | 2009-035346 | | 2/2009 |

* cited by examiner

PRINTING APPARATUS AND PRINTING METHOD THEREFOR

BACKGROUND

1. Technical Field

The present invention relates to a printing apparatus such as an ink jet printer and a printing method for the same apparatus.

2. Related Art

As printing paper used in ink jet printers, paper, which has a definite shape prescribed in advance on the basis of various standards, is generally used. For example, in an office ink jet printer and the like, elongated paper which is wound in a roll shape is used, a printing process is performed thereon, and a part of the paper, on which the process is performed, is transported forward to the downstream side and is cut, thereby dividing the part, on which the printing process is performed, from a non-printed part of the printing paper. In addition, in such an ink jet printer, the non-printed part of the printing paper is transported backward to a print position, and thus the printing process is performed thereon again.

As described above, in a case of the configuration in which the elongated printing paper is cut each time the printing process is performed, paper dust may be generated at the time of cutting. In this case, when the printing paper is transported backward to the print position, the printing may be performed in a state where the paper dust remains on the surface of the printing paper, or the paper dust, which flies during the backward transport, may become attached to the printing head of the ink jet printer. This may cause abnormal operations in the printing or deterioration in print precision. Hence, for example, in the ink jet printer disclosed in JP-A-2003-39757, a suction hole is provided near the print position, thereby suctioning and removing paper dust through the suction hole.

However, in the ink jet printer used in the related art as disclosed in JP-A-2003-39757, even when the paper dust can be removed by suctioning the paper dust through the suction hole, the non-printed part of the paper, on which the paper dust is attached, is temporarily transported backward to the vicinity of the print position. Hence, the paper dust, which is in a state before the suctioning or was not suctioned, may scatter in the vicinity of the print position. In this case, in the printing process, there is a concern of reattachment of the dust to the printing paper or the printing head, and thus in this respect there is room for improvement.

Further, such a problem arises not only in ink jet printers but also in printers which have different printing modes such as an electrophotographic method and a thermal transfer method. Furthermore, a common problem may also arise even in different printing apparatuses which perform the printing process on, for example, a cloth, a resin film, a resin sheet, a metal sheet, or the like, then cut it, and perform the printing process on the non-printed part thereof.

SUMMARY

An advantage of some aspects of the invention is to provide a printing apparatus, which is capable of appropriately preventing the cutting dust attached to the non-printed part of the printing medium from having an adverse effect on the printing process, and a printing method therefor.

According to an aspect of the invention, there is provided a printing apparatus including: a transporting unit that transports an elongated printing medium along a transport path; a printing unit that performs a printing process on the printing medium, which is transported forward from an upstream side to a downstream side by the transporting unit, at a print position in the transport path; a cutting unit that cuts the printing medium at a cutting position on the downstream side of the print position so as to divide a part of the printing medium, on which the printing process is performed, from a non-printed part thereof on the upstream side of the part; and a removing unit that removes cutting dust, which is attached to the non-printed part, at a removal position on the downstream side of the cutting position when the printing medium is transported forward such that a downstream side end of the non-printed part is positioned on the downstream side of the cutting position by the transporting unit. The printing medium is transported backward to the print position, and the printing unit performs the printing process on the non-printed part thereof from which the cutting dust is removed by the removing unit.

In the aspect of the invention, the printing medium, on which the printing unit performs the printing process at the print position in the transport path, is transported forward to the downstream side of the transport path, and is cut at the cutting position on the downstream side thereof. Thereby, in the printing medium, the printed part thereof is divided from the non-printed part thereof. The printing medium, from which the printed part is divided in such a manner, is transported backward to the print position on the upstream side in the transport path, and the printing process is performed on the non-printed part thereof. Here, as described above, when the printing medium is cut, the cutting dust is generated from the cut portion, and is thus attached to the vicinity of the cut portion. Hence, before the printing process is performed on the non-printed part, the printing medium is transported forward such that the downstream side end of the non-printed part is positioned on the downstream side of the cutting position, and the cutting dust, which is attached to the non-printed part particularly to the vicinity of the downstream side end thereof, is removed.

Here, according to the aspect of the invention, the cutting dust is removed at the removal position on the downstream side of the cutting position of the printing medium. Hence, when the printing medium is cut and then transported backward and the printing process is performed on the non-printed part, it is possible to prevent the non-printed part, onto which the cutting dust is attached, in an area to be printed from being transported backward. Accordingly, it is possible to prevent the cutting dust, which is attached on the non-printed part of the printing medium, from having adverse effects on the printing process. The adverse effects include difficulty to perform normal printing, a decrease in printing precision, and the like.

Further, in the printing apparatus according to the aspect of the invention, it is preferable that the removing unit should include a pair of pinching members for pinching the non-printed part at the removal position when the printing medium is transported backward to the upstream side by the transporting unit such that the printing process is performed on the non-printed part of the printing medium which is cut by the cutting unit.

According to the aspect of the invention, at the time of removing the cutting dust which is attached on the non-printed part of the printing medium, the printing medium is transported backward in the state where the non-printed part is pinched by the pair of pinching members. Hence, it is possible to appropriately remove the cutting dust, which is attached on the non-printed part, in a method of sweeping the cutting dust from the non-printed part through the respective pinching members. Furthermore, while the printing medium is transported backward to the print position such that the printing process is performed on the non-printed part, the cutting dust is removed. Hence, it is possible to shorten the time until the printing process is restarted by removing the cutting dust after the printing process ends.

Further, in the printing apparatus according to the aspect of the invention, it is preferable that the pair of pinching members should pinch the non-printed part in a state where at least one of the pinching members is elastically deformed.

However, in order to remove the cutting dust which is attached to the non-printed part in the method of sweeping the cutting dust through the pair of pinching members, it is preferable to transport the printing medium backward in a state where each pinching member is in tight contact with the non-printed part of the printing medium, in other words, in a state where contact pressure therebetween is high. In this respect, according to the aspect of the invention, one or both of the pinching members pinch the non-printed part of the printing medium in a state where one or both thereof are elastically deformed. Hence, the contact pressure between the pinching members and the non-printed part can be increased by elastic force which is generated when the pinching members elastically deformed are about to return to original shapes thereof. Thus, it is possible to improve the ability of the pinching members for removing the cutting dust.

Further, in the printing apparatus according to the aspect of the invention, it is preferable that the removing unit should include a driving section which displaces at least one of the pair of pinching members such that it approaches or separates from the non-printed part.

In order to pinch the non-printed part by the pinching members capable of improving the removal ability for the cutting dust by pinching the non-printed part in the state where the pinching members are elastically deformed, the printing medium is transported forward such that the downstream side end of the non-printed part is positioned on the downstream side of the cutting position. In this case, there is a concern that it may be difficult to pass the non-printed part through the gap between the pinching members. In this respect, according to the aspect of the invention, there is provided the driving section that displaces one or both of the pair of pinching members such that it approaches or separates from the non-printed part. Hence, in order to pass the non-printed part through the gap between the pinching members, the pinching members are displaced to separate from the non-printed part, whereby it is possible to smoothly pass the non-printed part through the gap between the pinching members. On the other hand, in order to remove the cutting dust which is attached to the non-printed part, the pinching members are displaced to approach the non-printed part, whereby it is possible to make the pinching members pinch the non-printed part in the state where the contact pressure is high.

Further, in the printing apparatus according to the aspect of the invention, it is preferable that the cutting unit should sequentially cut the printing medium from one end thereof toward the other end. In addition, it is also preferable that the pair of pinching members should be provided to be able to pinch at least the other end of the printing medium.

Here, examples of the method of cutting the printing medium include: a cutting method of cutting a portion thereof to be divided into the printed part, on which the printing process is performed, and the non-printed part in a single sweep; a cutting method of sequentially cutting a portion to be divided from one end to the other end in the cutting direction. In addition, in the latter cutting method, the cutting dust generated by the cutting moves from the one end side as the tail end to the other end side as the leading end in the cutting direction, and tends to be eccentrically distributed on the other end side. In this respect, according to the aspect of the invention, by removing the cutting dust in the state where the other end portion is pinched by the pair of pinching members, it is possible to more effectively remove the cutting dust.

Further, in the printing apparatus according to the aspect of the invention, it is preferable that the pair of pinching members should be a pair of transport rollers constituting a part of the transporting unit.

The pair of pinching members, which has a function of removing the cutting dust, may be separately provided. However, similarly to the aspect of the invention, the pair of transport rollers, which are provided to transport the printing medium, may be configured to have the removal function. As described above, when the transport rollers are used as the pinching members, it is not necessary to separately provide the member for removing the cutting dust, and it is possible to achieve simplification in the configuration of the printing apparatus.

Further, in the printing apparatus according to the aspect of the invention, it is preferable that the removing unit should have a rotation control section that controls rotation of at least one of the pair of transport rollers when the cutting dust is removed by transporting the printing medium backward in a state where the non-printed part is pinched by the pair of transport rollers.

In the case where the transport rollers are used as the pinching members, it is preferable to adopt a configuration in which the rotation of one or both of the transport rollers is regulated when the cutting dust is removed by transporting the printing medium backward while pinching the non-printed part through the transport rollers. In this respect, according to the aspect of the invention, the rotation of each transport roller is regulated by the rotation control section. Hence, sliding friction force is generated between the non-printed part and the transport rollers of which the rotations are regulated. In addition, the sliding friction force is extremely large as compared with rolling friction force which is generated between the non-printed part and the transport rollers in a case where the rotations of the transport rollers are not regulated. Accordingly, by adopting the configuration, it is possible to remove the cutting dust in the state where large friction force is generated between the non-printed part and the transport rollers, and thus it is possible to further improve the removal ability. In addition, in order to regulate the rotations of the transport rollers, a mechanism for forcibly regulating the rotations may be separately provided. If the transport rollers are rotationally driven by a motor at the time of the transport of the printing medium, the rotations of the transport rollers may be regulated by stopping the rotation of the motor.

Further, according to another aspect of the invention, there is provided a printing method for a printing apparatus including the steps of: performing a printing process on an elongated printing medium at a print position in a transport path by transporting the printing medium forward from an upstream side to a downstream side along the transport path; dividing a part of the printing medium, on which the printing process is performed, from a non-printed part thereof on the upstream side of the part by transporting the printing medium forward and cutting the printing medium at a cutting position on the downstream side of the print position; transporting the printing medium backward to the print position, after removing cutting dust, which is attached to the non-printed part, at a removal position on the downstream side of the cutting position by transporting the printing medium forward so as to position a downstream side end of the non-printed part on the downstream side of the cutting position; and performing a printing process on the non-printed part of the printing medium which is transported backward to the print position.

Further, in the printing method for the printing apparatus according to the aspect of the invention, it is preferable that, in the process of transporting the printing medium backward, the printing medium should be transported backward to the print position in a state where the non-printed part of the printing medium is pinched at the removal position by using a pair of pinching members.

According to the printing method for the printing apparatus of the aspect of the invention, it is possible to obtain the same advantages as the printing apparatus with the above-mentioned configuration according to the aspect of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as a specific example of a printing apparatus according to an embodiment of the invention, an ink jet printer will be described.

Figure 1:
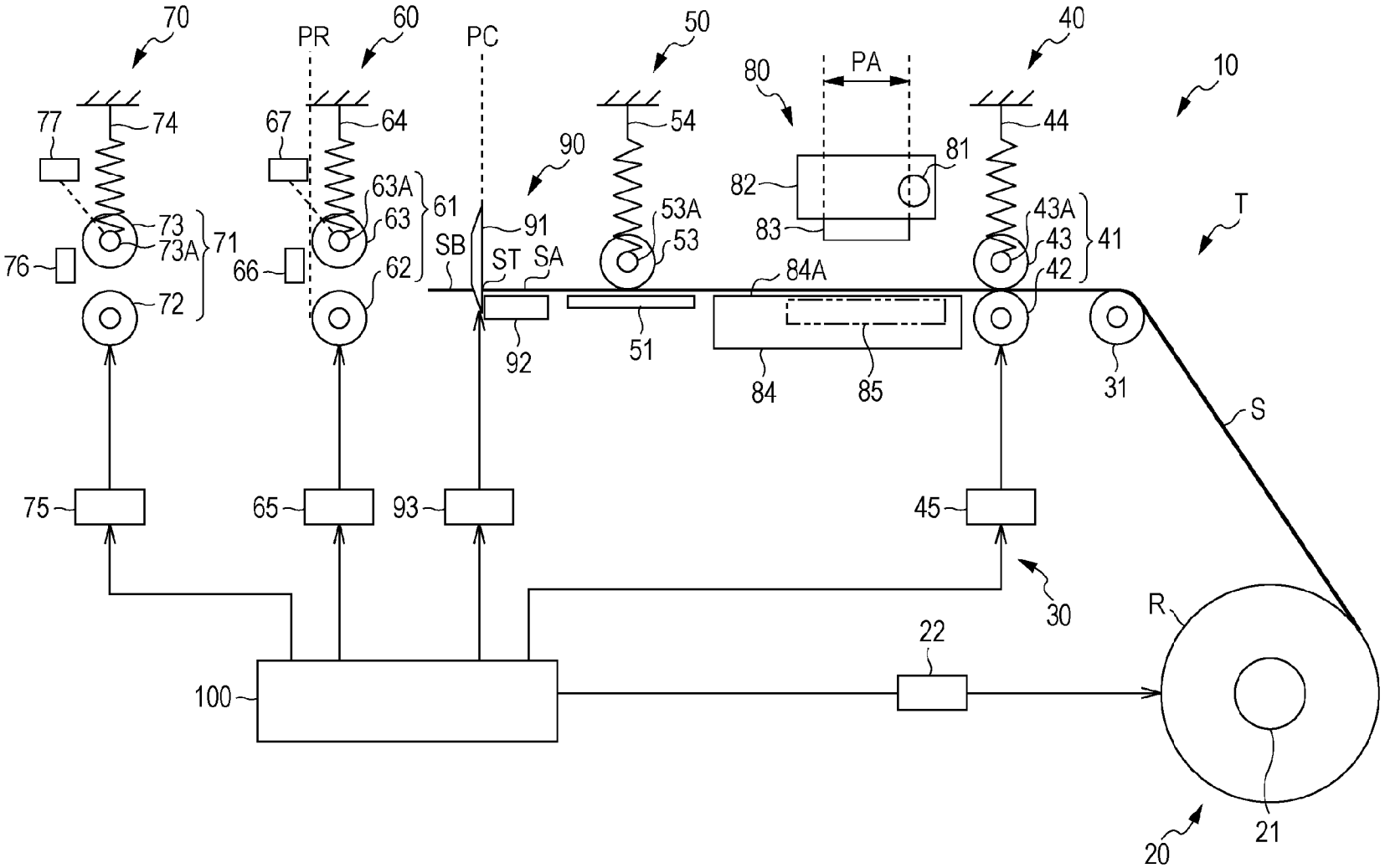
FIG. 1 is a schematic configuration diagram illustrating a schematic configuration of a printer according to the embodiment.

As shown in FIG. 1, the printer 10 is provided with: a drawing-out section 20 that has a function of sequentially drawing out a printing paper S by rotating the roller body R around which the printing paper S as an elongated printing medium is wound in a roll shape; a transport mechanism 30 that transports the printing paper S which is drawn out; a printing section 80 that performs a printing process as a recording process by ejecting ink onto the printing paper S; and a cutting section 90 that cuts the printing paper S on which the printing process is performed. Further, the printer 10 is provided with a control device 100 that controls the operations of the drawing-out section 20, the transport mechanism 30, the printing section 80, and the cutting section 90.

The drawing-out section 20 is provided with a roller shaft 21 that supports the roller body R, and a drawing-out motor 22 that is for rotating the roller shaft 21.

The transport mechanism 30, which functions as the transporting unit, is provided with: a rotatable relay roller 31 on which the printing paper S drawn out from the roller body R by the drawing-out section 20 is suspended around the circumferential surface thereof; and first to fourth transport mechanisms 40, 50, 60, and 70 which transport the printing paper S from the relay roller 31 to the cutting section 90 through the printing section 80. In the following description, "forward transport" means a case where the printing paper S drawn out from the roller body R is transported from the relay roller 31 and the first transport mechanism 40 to the second transport mechanism 50 through the printing section 80 and is transported in order from the second transport mechanism 50 to the third transport mechanism 60 and fourth transport mechanism 70 through the cutting section 90. That is, "forward transport" means a case where the printing paper S is transported from the upstream side to the down stream side when the roller body R is the most upstream portion. In contrast, "backward transport" means a case where the printing paper S is transported from the downstream side to the upstream side. In addition, a transport path T of the printing paper S is determined by a supporting position of the roller body R and the arrangement of the relay roller 31, the first to fourth transport mechanisms 40, 50, 60, and 70.

The first, third, and fourth transport mechanisms 40, 60, and 70 are respectively provided with transport rollers 41, 61, and 71 each serving as a pair of pinching members for transporting the printing paper S forward or backward while pinching the paper. The respective transport rollers 41, 61, and 71 are provided with respective driving rollers 42, 62, and 72 which are connected to transport motors 45, 65, and 75 so as to be able to transmit power, and respective driven rollers 43, 63, and 73 which are disposed to face the respective driving rollers 42, 62, and 72 with the printing paper S interposed therebetween.

The respective transport motors 45, 65, and 75 rotate the respective driving rollers 42, 62, and 72 forward, thereby transporting the printing paper S forward. On the other hand, the respective transport motors reversely rotate the respective driving rollers 42, 62, and 72, thereby transporting the printing paper S backward. Further, the respective transport motors 45, 65, and 75 function as rotation control sections for regulating rotations of the respective driving rollers 42, 62, and 72 by stopping the rotations. In addition, the output shafts of the respective transport motors 45, 65, and 75 are respectively provided with rotary encoders 45A, 65A, and 75A (refer to FIG. 3) for detecting a rotation speed, a rotation position, and a rotation direction.

On the other hand, respective rotary shafts 43A, 63A, and 73A of the respective driven rollers 43, 63, and 73 are respectively equipped with springs 44, 64, and 74 for urging the respective driven rollers 43, 63, and 73 in a direction of approaching the corresponding driving rollers 42, 62, and 72. In addition, the respective transport rollers 41, 61, and 71 bring the respective driving rollers 42, 62, and 72 and the respective driven rollers 43, 63, and 73 into contact with the printing paper S by elastic forces of the springs 44, 64, and 74 so as to pinch the paper, thereby applying a friction force for transporting the printing paper S forward or backward.

The second transport mechanism 50 is provided with a guide member 51, which is for guiding a position of the printing paper S in a width direction W, and a driven roller 53 which is disposed to face the guide member 51 with the printing paper S interposed therebetween. A rotary shaft 53A of the driven roller 53 is provided with a spring 54 which urges the driven roller 53 in a direction of approaching the guide member 51. As described above, by urging the driven roller 53 in the direction of approaching the guide member 51, the printing paper S is pinched in a state where the paper is in tight contact with the guide member 51 and driven roller 53.

The third transport mechanism 60 and fourth transport mechanism 70 are respectively provided with sensors 66 and 76, which detect presence or absence of the printing paper S, on the downstream side of the respective transport rollers 61 and 71. In addition, the control device 100 detects, on the basis of a detection signal output from the sensors 66 and 76, whether the downstream side end of the printing paper S reaches the third transport mechanism 60 or the fourth transport mechanism 70.

Here, in the transport roller 41, the driven roller 43 is consistently in contact with the printing paper S by the elastic force of the spring 44. In contrast, the respective transport rollers 61 and 71 are configured such that those can be elevated by the respective cam mechanisms 67 and 77 which function as driving sections for displacing the driven rollers 63 and 73 such that the rollers approach or separate from the printing paper S. Accordingly, the driven rollers 63 and 73 are brought into tight contract with the printing paper S by the elastic forces of the respective springs 64 and 74, but when displaced in a direction of separating from the printing paper S by the respective cam mechanisms 67 and 77, the driven rollers 63 and 73 are not in contact with the printing paper S.

Specifically, in the respective transport rollers 61 and 71, the respective driven rollers 63 and 73 are displaced such that they approach the printing paper S, and the respective driven rollers 63 and 73 and the respective driving rollers 62 and 72 are disposed without spaces interposed therebetween, thereby applying clamping force to the printing paper S. Further, the respective driven rollers 63 and 73 are displaced such that the bottoms of the circumferential surfaces thereof separate upward from the printing paper S, and the respective driven rollers 63 and 73 and the respective driving rollers 62 and 72 are disposed with spaces interposed therebetween, thereby not applying the clamping force to the printing paper S. As described above, in the respective transport rollers 61 and 71, the state, in which the clamping force is applied to the printing paper S, and the state, in which the clamping force is not applied thereto, are changeable.

The printing section 80, which functions as the printing unit, includes a guide shaft 81 which is disposed on the other side (the upper side in FIG. 1) of the transport path T, a carriage 82 which is supported on the guide shaft 81, and a printing head 83 which is supported on the carriage 82. The guide shaft 81 is provided to extend along the width direction W. The carriage 82 reciprocates in the width direction W while being guided by the guide shaft 81.

Further, the printing section 80 includes a supporting member 84 which is disposed on one side (the lower side in FIG. 1) with the transport path T interposed therebetween. The supporting member 84 supports the printing paper S which is transported to a supporting surface 84A provided on the upper surface side thereof. In the supporting member 84, a plurality of suction holes (not shown) are formed on the upper surface side, and a suctioning mechanism 85 for adhering the printing paper S to the upper surface through the suction holes is built therein.

The printing head 83 is provided with a plurality of nozzles (not shown) for ejecting ink. In addition, the ink is ejected from the nozzles of the printing head 83 onto the surface (the upper surface in FIG. 1) of the printing paper S which is supported by the supporting member 84, thereby performing printing. In the following description, the portion, at which the ink is ejected from the nozzles of the printing head 83, is referred to as a "print position PA".

The cutting section 90, which functions as the cutting unit, is provided between the second transport mechanism 50 and the third transport mechanism 60. The cutting section includes a rotary blade 91 which is disposed on the other side (the upper side in FIG. 1) of the transport path T, a stationary blade 92 which is disposed on one side (the lower side in FIG. 1) with the transport path T interposed therebetween, and a cutter motor 93. The rotary blade 91 moves along the width direction W while rotating by the driving of the cutter motor 93, thereby cutting the printing paper S.

In the following description, the portion, at which the printing paper S is cut by the cutting section 90, is referred to as a "cutting position PC". Further, the direction, in which the rotary blade 91 moves from one end to the other end of the printing paper S such that it sequentially cuts the printing paper S, is referred to as a "cutting direction Z". Further, in the printing paper S which is cut by the rotary blade 91, a part thereof, on which the printing is performed, is referred to as a "printed part SB", and another part thereof, on which the printing is not performed, is referred to as a "non-printed part SA".

Figure 2:
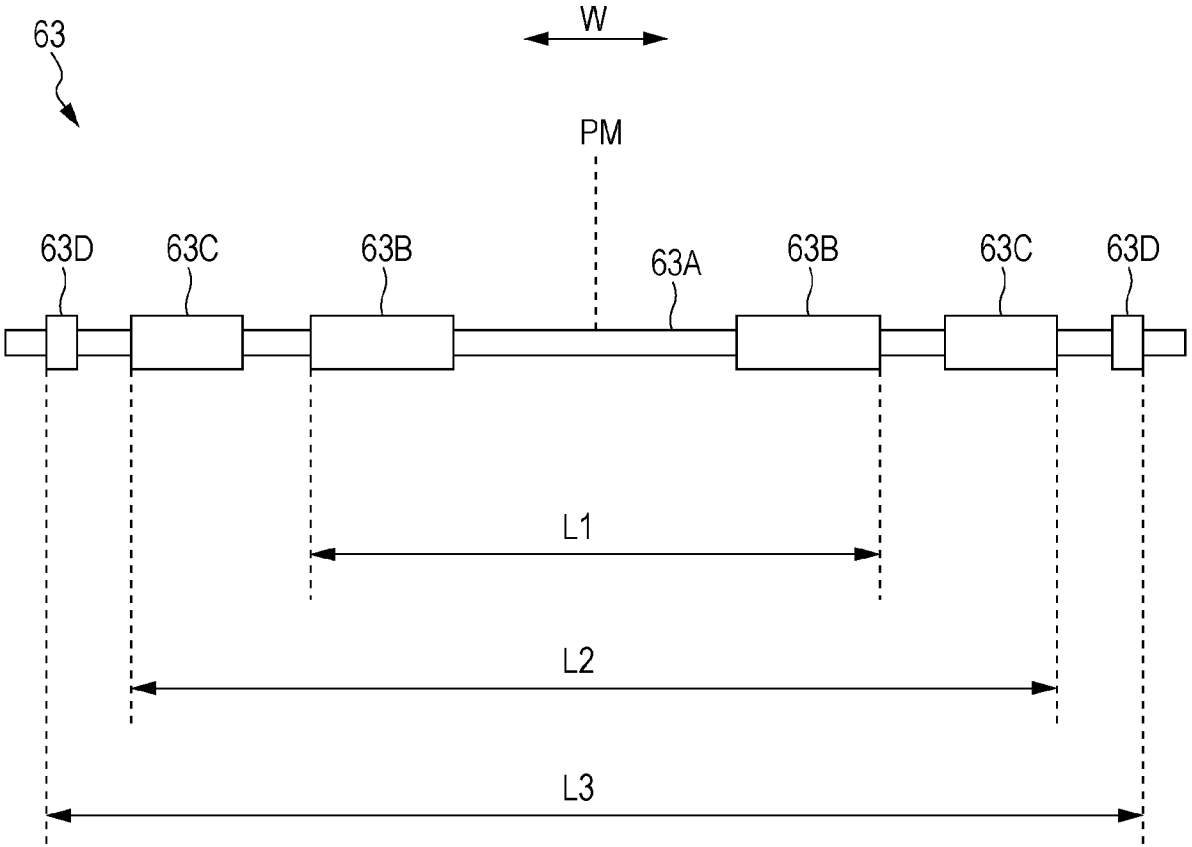
FIG. 2 is a schematic front view schematically illustrating a frontal structure of a driven roller of the printer.

Referring to FIG. 2, a specific structure of the driven roller 63 in the transport roller 61 will be described.

The driven roller 63 is provided with three pairs of rollers, where each pair is positioned such that two rollers are symmetrical to each other when a middle position PM in the width direction W of the rotary shaft 63A is set as a reference position. Each first roller 63B is provided at a position closest to the middle position PM in the width direction. Further, each second roller 63C is provided at a position at which it is spaced farther from the middle position PM than the first roller 63B. Further, each third roller 63D is disposed at a position at which it is spaced farther from the middle position PM than the second roller 63C.

Here, the distance between the respective first rollers 63B symmetrical to each other is represented by "L1". The distance between the respective second rollers 63C symmetrical to each other is represented by "L2". The distance between the respective third rollers 63D symmetrical to each other is represented by "L3".

The first rollers 63B transport the printing paper S by pinching the end portions of the printing paper S of which the length in the width direction W is L1. Further, second rollers 63C transport the printing paper S by pinching the end portions of the printing paper S of which the length in the width direction W is L2. Further, the third rollers 63D transport the printing paper S by pinching the end portions of the printing paper S of which the length in the width direction W is L3.

That is, the transport roller 61 is disposed at a position at which the length thereof in the width direction W is adjusted to the length of the printing paper S in the width direction W. Thereby, the transport roller 61 transports the printing papers S while pinching the end portions of the printing papers S of which the lengths in the width direction W are different in accordance with the printing processes.

In addition, the driven roller 63 is formed of a porous material such as a sponge which can be elastically deformed. Accordingly, when the printing paper S is pinched by the transport roller 61, the driven roller 63 is pressed in the direction of approaching the driving roller 62, thereby pinching the printing paper S in a state where the roller is elastically deformed. On the other hand, the driving roller 62 is formed of a metal material, and is thus not deformed even when pinching the printing paper S.

Next, an electric configuration of the printer 10 will be described.

Figure 3:
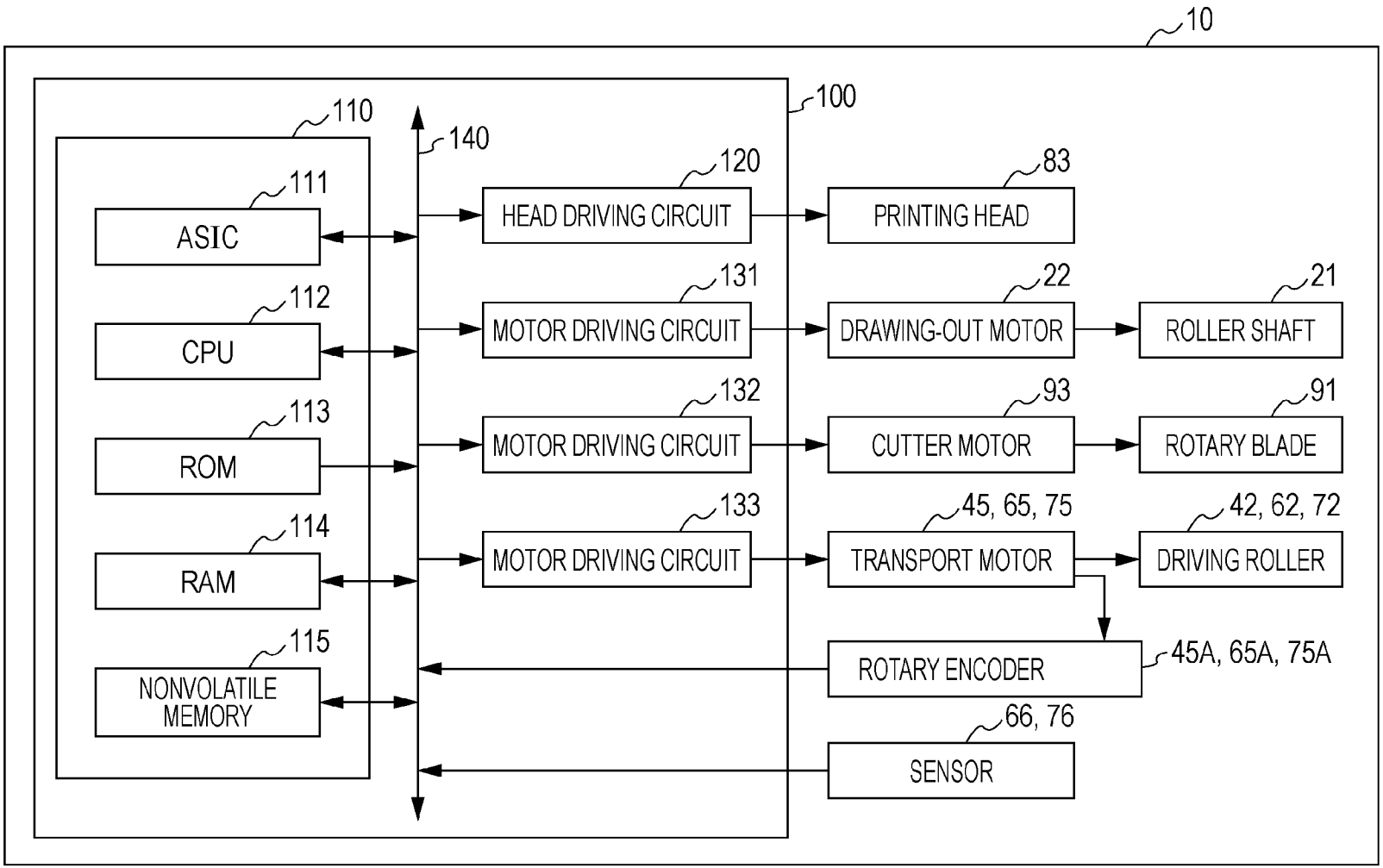
FIG. 3 is a block diagram illustrating an electric configuration of the printer.

As shown in FIG. 3, the control device 100 includes a computer 110, a head driving circuit 120, and motor driving circuits 131, 132, and 133. The computer 110 is electrically connected to the head driving circuit 120 and the motor driving circuits 131, 132, and 133 through a bus 140.

The computer 110 includes an ASIC (Application Specific IC) 111, a CPU 112, a ROM 113, a RAM 114, and a nonvolatile memory 115.

The ROM 113 stores various control programs, various data, and the like. The nonvolatile memory 115 stores various programs such as a firmware program and various data necessary for the printing process. The RAM 114 temporarily stores data of programs which are executed by the CPU 112, various data which includes results of processes and calculations performed by the CPU 112, and various data processed by the ASIC 111.

The computer 110 performs various controls by causing the CPU 112 to execute the programs stored in the ROM 113. For example, the computer 110 controls the printing head 83 through the head driving circuit 120, and controls, through the respective motor driving circuits 131, 132, and 133, the drawing-out motor 22, the cutter motor 93, the respective transport motors 45, 65, and 75.

Furthermore, the computer 110 controls, on the basis of the detection signals transmitted from the respective rotary encoders 45A, 65A, and 75A and the detection results of the sensors 66 and 76, the driving of the printing head 83, the drawing-out motor 22, the respective transport motors 45, 65, and 75, and the cutter motor 93.

Next, the operations of the printer 10 will be described.

When the printing process is executed, the roller shaft 21 is rotated by driving the drawing-out motor 22. Thereafter, by driving the transport motors 45, 65, and 75, the respective transport rollers 41, 61, and 71 are rotated forward, and the printing paper S is transported forward along the transport path T. In addition, the printing paper S is transported to the print position PA in the transport path T while the position thereof in the width direction W is guided by the supporting member 84 or the guide member which is not shown. In a first process (a printing process after the forward transport), the printing section 80 performs the printing process on the printing paper S at the print position PA.

In addition, in the printer 10, the print data included in a single printing process is divided into a plurality of pieces, the printing process based on each divided piece of the print data is performed for each scanning of the carriage 82, and parts of the printing paper S, on which the printing is performed, are intermittently transported between the printing processes. That is, in the printing section 80, by alternately repeating transport of the paper and formation of strip-shaped images of which the lengthwise direction corresponds to the width direction W, an image based on the single printing process is formed.

Next, in a second process (a separation process), the printing paper S, on which the printing is printed, is cut by the cutting section 90 at the cutting position PC on the downstream side of the print position PA. Thereby, the printing paper S is divided in to the non-printed part SA, which is positioned on the upstream side of the cutting section 90, and the printed part SB which is positioned on the downstream side of the cutting section 90. The printing paper S is cut in a state where the transport of the printing paper S performed by the transport mechanism 30 is stopped, the upstream side portion thereof is held by the suctioning mechanism 85 of the supporting member 84, and the downstream side portion thereof is pinched and held by the transport roller 61. In the following description, the downstream side end portion of the non-printed part SA is referred to as a "leading end portion ST".

Further, the printer 10 performs printing on the portion on the upstream side of the cutting position PC, and thus the printing paper S is cut at the timing of stopping the transport of the printing paper S. Specifically, on the basis of the rotation speed of the driving roller 62 at the time of detecting the signal transmitted from the sensor 66 and the time which passes after the detection, the distance, by which the printing paper S is transported from the sensor 66 to the downstream side, is calculated, and on the basis of the calculation result, the printing paper S is cut when the driving of the driving roller 62 is stopped. In addition, the printed part SB, which is formed as a cut sheet by the cutting, is continuously transported without being stopped by the transport mechanism 30, and is discharged to a sheet discharging section which is not shown.

In addition, in the printer 10, the printing section 80 prints, for example, photos with a predetermined print size by printing a plurality of images while forming spaces as margins on the surface of the elongated printing paper S and by sequentially cutting the leading end sides of the printing paper S in the margin portions.

When the printing process is intended to be performed on the printing paper S after the cutting of the printing paper S is executed, ahead of the printing process, in a third process (a backward transport process), the respective driving rollers 42, 62, and 72 are rotated backward, thereby transporting the leading end portion ST of the printing paper S backward. That is, the work of the portion of the printing paper S, which is not printed even when passing the printing head 83, being returned to the position on the most downstream side in the area which faces the printing head 83 is executed.

However, in the printer 10, when the printing paper S is cut, the paper dust as the cutting dust is generated in the vicinity of the leading end portion ST, and particularly, the paper dust is eccentrically distributed in the cutting direction Z. In addition, an adverse effect on printing, which is caused by the paper dust attached to the printing paper S when the printing paper S is transported backward to the print position PA, is as described above.

On the other hand, in the printer 10, the leading end portion ST of the non-printed part SA, which is cut at the cutting position PC, is transported forward so as to be positioned on the downstream side of the transport roller 61 which is disposed on the downstream side of the cutting position PC, and then the non-printed part SA is transported backward to the print position PA in a state where the part is pinched by the transport roller 61.

Referring to FIGS. 4 to 8, a description will be given of a series of processes which is executed by the printer 10 after the first process. Here, a description will be given of operations of the configuration of arrangement of the first to third transport mechanisms 40 to 60, and operations of the other configuration will be omitted.

Figure 5:
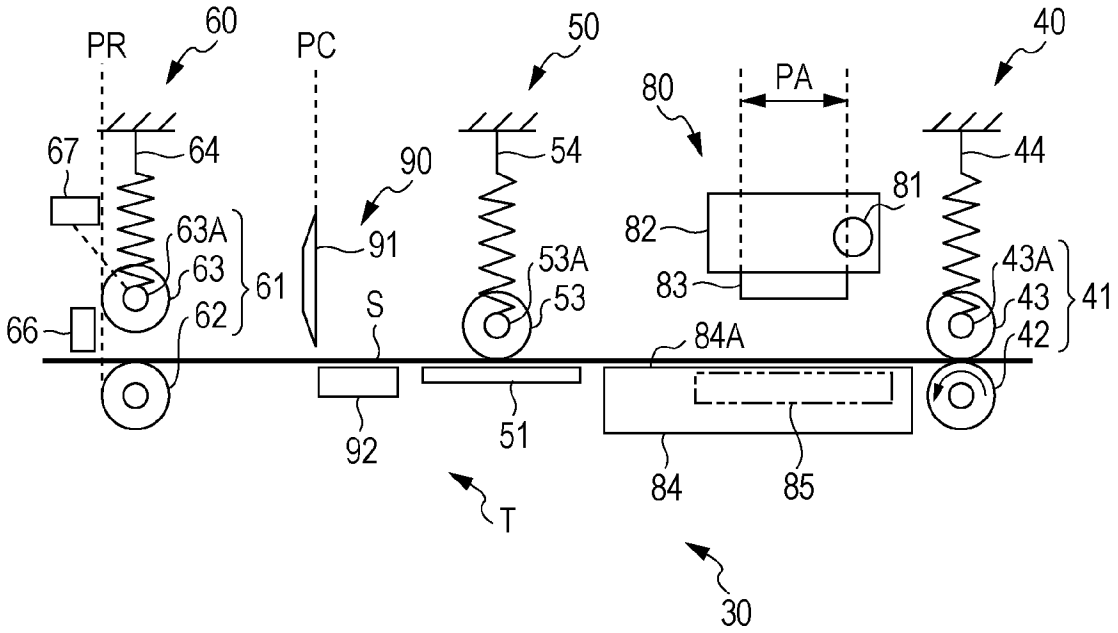
FIG. 5 is a schematic side view schematically illustrating a side structure including first to third transport mechanisms in the printer.

As shown in FIG. 5, the printing paper S is transported forward after the first process.

That is, the control device 100 causes a transport motor 45 to rotate the driving roller 42 of the transport roller 41 forward. Thereby, the transport roller 41 transports the printing paper S forward by applying a force for transport to the printing paper S in a state where the roller pinches the printing paper S. Then, the leading end portion of the printing paper S on the downstream side passes the position, at which the cutting section 90 is disposed, toward the downstream side, and thereafter enters to the position at which the third transport mechanism 60 is disposed. At this time, when the driven roller 63 is disposed to be separated upward from the printing paper S by the cam mechanism 67, the transport roller 61 does not apply the clamping force to the printing paper S.

Figure 6:
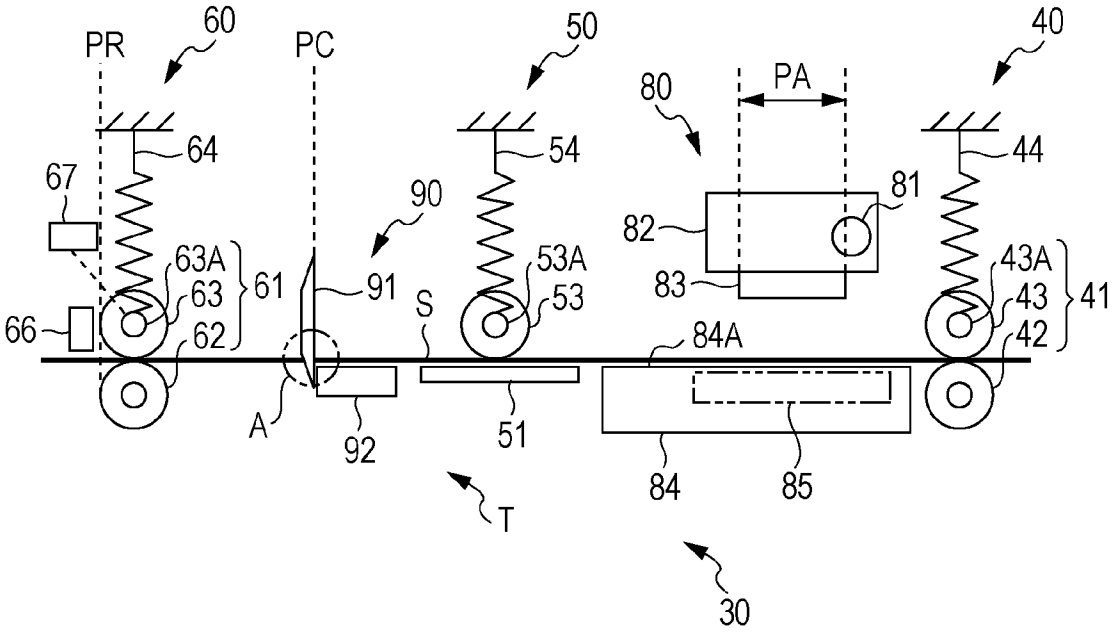
FIG. 6 is a schematic side view schematically illustrating a side structure including first to third transport mechanisms in the printer.

As shown in FIG. 6, in the second process which is executed after the first process, on the basis of the signal transmitted from the sensor 66, the printing paper S is cut at the cutting position PC by the cutting section 90.

That is, the control device 100 calculates a distance by which the printing paper S is transported from the time the sensor 66 detects the printing paper S. Then, on the basis of the calculation result, for example, when the leading end portion of the printing paper S is transported forward to the position P1 in FIG. 4, the rotation driving of the driving rollers 42 and 62 is stopped by stopping the driving of the transport motors 45 and 65. At this time, the driven roller 63 is disposed to be close to the printing paper S, whereby the transport roller 61 applies the clamping force to the printing paper S.

In addition, the control device 100 drives the cutter motor 93 under the situation in which the printing paper S is pinched by the transport rollers 41 and 61, thereby rotating the rotary blade 91. In such a manner, the printing paper S is divided into the non-printed part SA and the printed part SB.

At this time, the paper dust is generated in the vicinity of the leading end portion ST of the non-printed part SA on the downstream side and the leading end portion of printed part SB on the upstream side, that is, the paper dust is generated in the portion A which is surrounded by the chain line of FIG. 6. Particularly, in the end portion (the portion A which is surrounded by the chain line of FIG. 4) in the cutting direction Z, the paper dust is eccentrically located.

Figure 7:
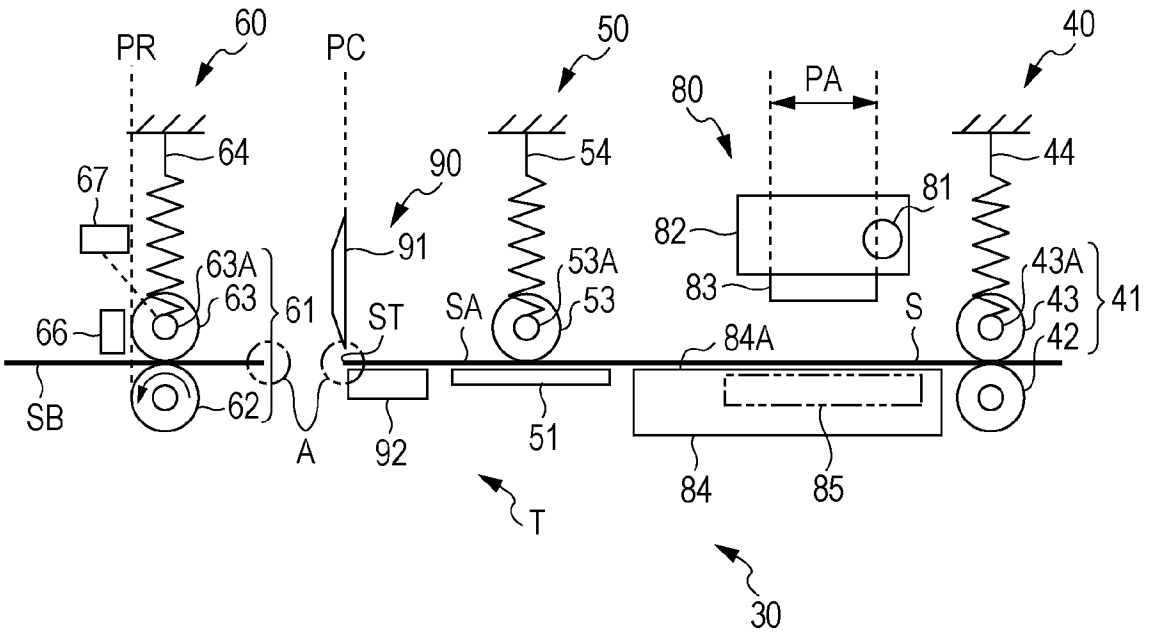
FIG. 7 is a schematic side view schematically illustrating a side structure including first to third transport mechanisms in the printer.

As shown in FIG. 7, in a sheet discharging process executed after the second process, the printed part SB, which is cut, is transported to the sheet discharging section on the downstream side.

That is, the control device 100 rotates the driving roller 62 of the transport roller 61 forward by driving the transport motor 65. Thereby, the transport roller 61 transports the printing paper S forward by applying the force for transport to the portion SB in a state where the printed part SB is pinched, and discharges the paper to the sheet discharging section. At this time, the control device 100 stops driving the transport motor 45, thereby stopping the rotation of the driving roller 42.

Figure 8:
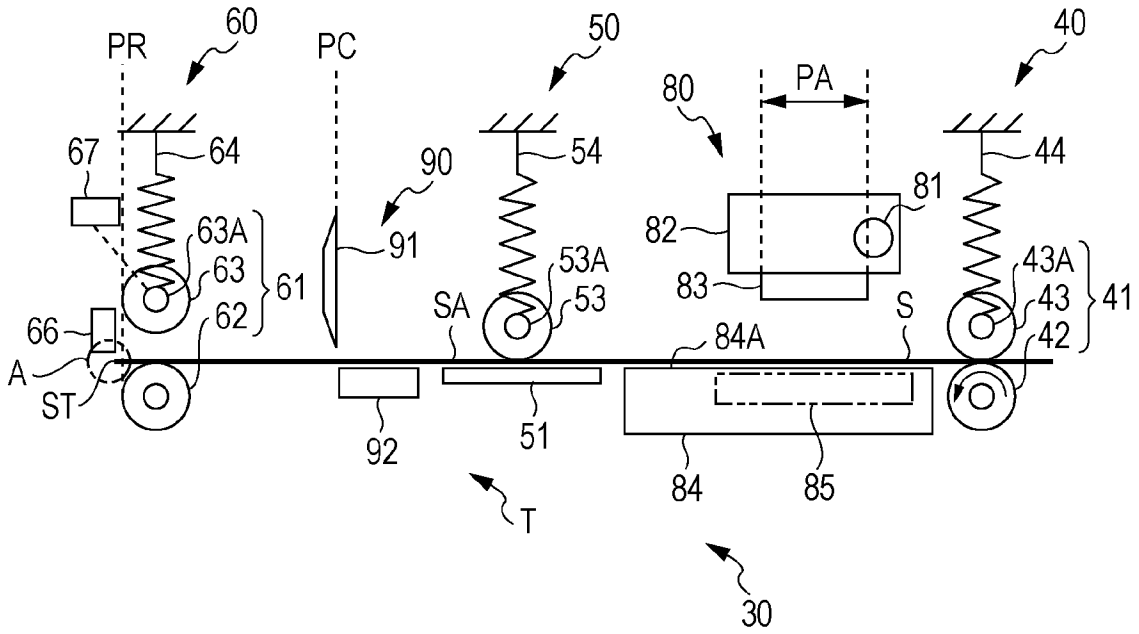
FIG. 8 is a schematic side view schematically illustrating a side structure including first to third transport mechanisms in the printer.

As shown in FIG. 8, in a preprocess of the third process executed after the sheet discharging process, the leading end portion ST of the non-printed part SA is transported forward to the downstream side of the transport roller 61.

That is, the control device 100 rotates the driving roller 42 of the transport roller 41 forward by driving the transport motor 45. Thereby, the transport roller 41 transports the non-printed part SA forward to the downstream side of the cutting position PC. At this time, the driven roller 63 is disposed to be separated upward from the printing paper S, and thus the transport roller 61 does not apply the clamping force to the printing paper S.

Figure 9:
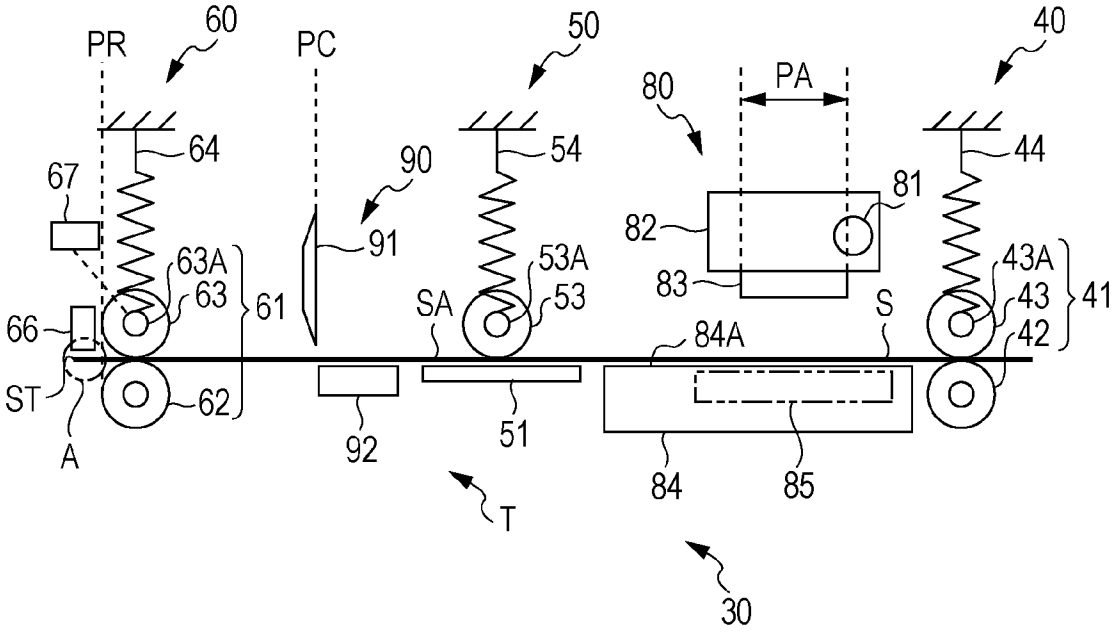
FIG. 9 is a schematic side view schematically illustrating a side structure including first to third transport mechanisms in the printer.

As shown in FIG. 9, in an intermediate process of the third process executed after the preprocess of the third process, the portion on the upstream side of the leading end portion ST of the non-printed part SA to which the paper dust is attached is pinched by the transport roller 61.

Figure 4:
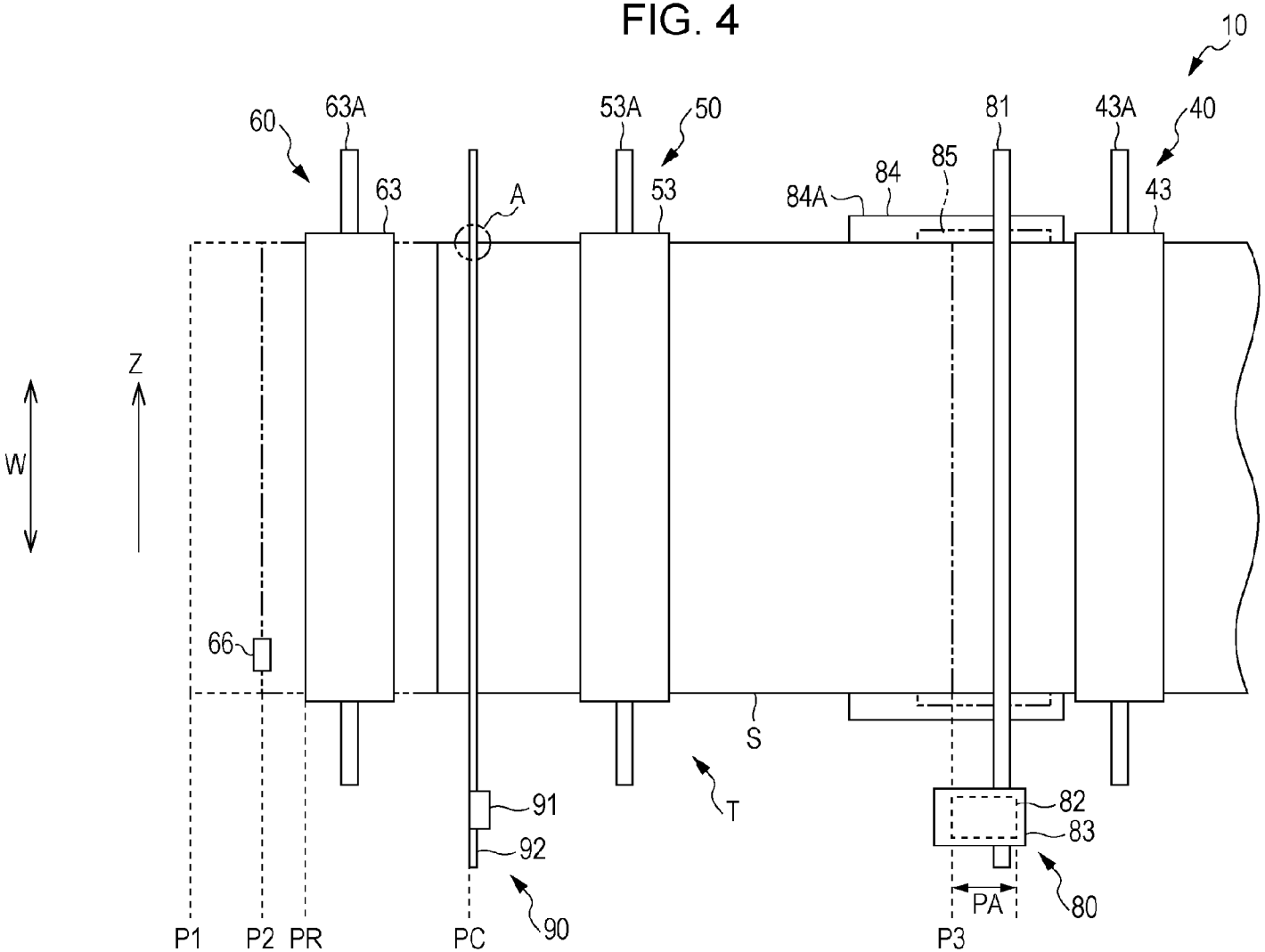
FIG. 4 is a schematic top plan view schematically illustrating a planar structure of the printer.

That is, the control device 100 determines, on the basis of the detection of the sensor 66 for the leading end portion ST of the non-printed part SA, that the leading end portion ST is transported to the position P2 in FIG. 4. In this case, the control device 100 stops driving the transport motors 45 and 65, thereby stopping the rotation of the driving rollers 42 and 62. At this time, the driven roller 63 is disposed to be close to the printing paper S, whereby the transport roller 61 applies the clamping force to the printing paper S in the state where the roller 63 is elastically deformed.

Figure 10:
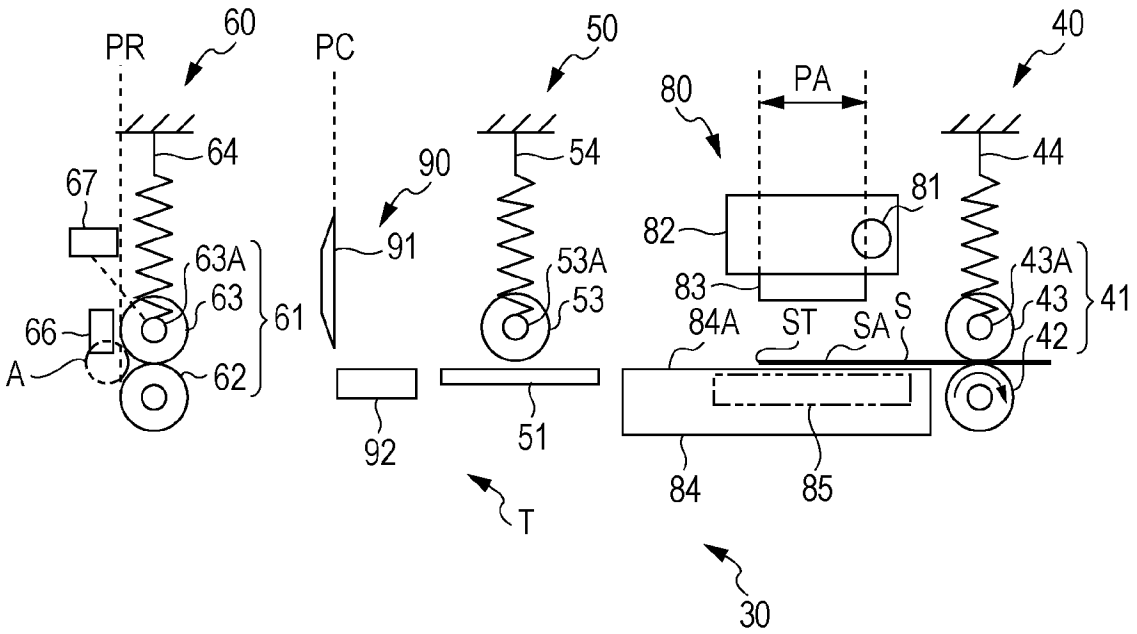
FIG. 10 is a schematic side view schematically illustrating a side structure including first to third transport mechanisms in the printer.

As shown in FIG. 10, in a post-process of the third process executed after the intermediate process of the third process, the paper dust is removed at the downstream side end (hereinafter, referred to as a "removal position PR") of the transport roller 61, and then the non-printed part SA is transported backward to the print position PA.

That is, the control device 100 causes the transport motor 45 to rotate the driving roller 42 of the transport roller 41 backward in a state where the rotation of the transport roller 61 is stopped. Thereby, the transport roller 41 transports the printing paper S backward by applying the force for transport to the printing paper S in a state where the printing paper S is pinched. At this time, the transport roller 61 sweeps out the paper dust, which is attached to the leading end portion ST of the non-printed part SA, from the leading end portion ST at the removal position PR.

In addition, the leading end portion ST of the non-printed part SA passes the positions, at which the cutting section 90 and the second transport mechanism 50 are disposed, toward the downstream side, and then enters the most downstream side (the position P3 in FIG. 4) at the print position PA.

In addition, in a fourth process (a printing process after the backward transport) executed after the post-process of the third process, the printing section 80 performs the printing process on the non-printed part SA at the print position PA.

As described above, the non-printed part SA is transported backward to the position (the position P3 in FIG. 4) on the downstream side of the print position PA in a state where the portion thereof on the upstream side of the leading end portion ST is pinched by the transport roller 61 with the paper dust attached to the leading end portion ST. At this time, the paper dust, which is attached to the leading end portion ST, is swept out from the printing paper S by the transport roller 61 at the removal position PR without passing the transport roller 61. That is, the paper dust is removed at the portion in which the driven roller 63 is elastically deformed and comes into tight contact with the printing paper S. As described above, the transport roller 61 functions as the removing unit.

According to the embodiment, the following effects can be obtained.

(1) Before the printing process is performed on the non-printed part SA, the printing paper S is transported forward such that the leading end portion ST of the non-printed part SA thereof is positioned on the downstream side of the cutting position PC, and the printing paper S is transported backward in a state where the non-printed part SA is pinched by the transport roller 61, thereby removing the paper dust. Hence, it is possible to prevent the non-printed part SA, to which the paper dust is attached, from being transported backward to the print position PA.

(2) When the paper dust attached to the non-printed part SA of the printing paper S is removed, the printing paper S is transported backward in a state where the non-printed part SA is pinched by the transport roller 61. Hence, it is possible to appropriately remove the paper dust, which is attached to the non-printed part SA, through the driving roller 62 and the driven roller 63 at the removal position PR in the method of sweeping the paper dust from the non-printed part SA.

(3) While the printing paper S is transported backward to the print position PA such that the printing process can be performed on the non-printed part SA, the paper dust is removed at the removal position PR. Hence, first, the printing process is terminated, and then the paper dust is removed, whereby it may be possible to shorten the time until the printing process is restarted.

(4) In the state where the driven roller 63 is elastically deformed, the non-printed part SA of the printing paper S is pinched. Hence, it is possible to increase the contact pressure between the transport roller 61 and the non-printed part SA by the elastic force which is generated when the driven roller 63 elastically deformed is about to return to its original shape. As a result, it is possible to improve the ability of the transport roller 61 for removing the paper dust.

(5) In the above-mentioned configuration, there is provided the cam mechanism 67 that displaces the driven roller 63 so as to make the roller approach or separate from the non-printed part SA. Hence, in order to pass the non-printed part SA through the gap of the transport roller 61, the driven roller 63 is displaced to separate from the non-printed part SA, whereby it is possible to smoothly pass the non-printed part SA through the gap of the transport roller 61. On the other hand, in order to remove the paper dust which is attached to the non-printed part SA, the driven roller 63 is displaced to approach the non-printed part SA, whereby it is possible to make the transport roller 61 pinch the non-printed part SA in the state where the contact pressure is high.

(6) The driven roller 63 is formed of a porous material. Hence, it is possible to capture the removed paper dust inside the fine pores. Accordingly, it is possible to prevent the paper dust, which is removed by the transport roller 61, from being reattached to the non-printed part SA.

(7) The transport roller 61 pinches the end portion (the other end portion in the embodiment) on the leading end side in the cutting direction Z, on which the paper dust is eccentrically located, between one end portion and the other end portion of the printing paper S in the cutting direction Z. In this state, the printing paper S is transported backward. Hence, it is possible to more effectively remove the paper dust.

(8) In order to transport the printing paper S, the transport roller 61 has a function of removing the paper dust. Hence, it is not necessary to separately provide a member for removing the paper dust, and it is possible to achieve simplification in the configuration of the printer 10.

(9) The printing paper S is transported backward while the non-printed part SA is pinched by the transport roller 61, thereby stopping the rotation of the driving roller 62 when removing the paper dust. Hence, the sliding friction force is generated between the non-printed part SA and the driving roller 62 of which the rotation is stopped. In addition, the sliding friction force is extremely large as compared with the rolling friction force which is generated between the non-printed part SA and the transport roller 61 in a case where the rotation of the transport roller 61 is not stopped. Accordingly, by adopting the configuration, it is possible to remove the cutting dust in the state where large friction force is generated between the non-printed part SA and the transport roller 61, and thus it is possible to further improve the removal ability.

In addition, the embodiment may be modified as follows.

By providing a guide shaft which extend along the width direction W of the printing paper S on the downstream side of the cutting position PC and providing a brush which comes into contact with the printing paper S on the guide shaft, the paper dust may be removed.

A mechanism capable of blowing the paper dust may be provided on the downstream side of the cutting position PC. Further, a pinching member for pinching the printing paper S without rotation may be provided.

The driven roller 63 may be formed of a adhesive material. With such a configuration, the removed paper dust can be captured by adhesion. Hence, it is possible to prevent the paper dust, which is removed by the transport roller 61, from being reattached to the non-printed part SA. Further, the driven roller 63 may be formed of a porous and adhesive material.

After the second process, the non-printed part SA is transported to the downstream side of the transport roller 61, then the driving roller 62 is rotated forward, and the non-printed part SA is transported backward, thereby removing the paper dust. In this case, the rotation direction of the transport roller 61 is opposite to the direction of returning the printing paper S. Hence, it is possible to sweep out the paper dust, which is attached to the surface of the printing paper S, toward the downstream side, and thus an effect of removing the paper dust increases.

In the above-mentioned modified example, instead of rotating the driving roller 62 forward, the driven roller may be rotated forward by providing a driving motor for driving the driven roller 63. Further, by providing a stopper for stopping the rotation of the driven roller 63, the driving roller 62 may be rotated forward, while the rotation of the driven roller 63 may be stopped.

The driving roller 62 may be formed of a sponge or the like which can be elastically deformed, and the driven roller 63 may be formed of a material such as a metal which is not elastically deformed. Further, either one of the rollers 62 and 63 may be formed of a material which can be elastically deformed.

The transport roller 61 at the end in the direction opposite to the cutting direction Z may be removed.

Instead of the plurality of rollers such as the first, second, and third rollers 63B, 63C, and 63D, rollers with the same diameter may be provided around the rotary shaft 63A and in the entirety of the drawing direction.

The cutting section 90 may be configured to simultaneously cut the portion in which the non-printed part SA is separated from the printed part SB at the cutting position PC.

Instead of cutting the printing paper S through the cutting section 90 on the basis of the signal transmitted from the sensor 66, the printing paper S may be cut by detecting the time of the rotation of the transport roller 41 and the rotation number of the driving roller 42 after the end of the printing process so as to calculate a distance by which the printing paper S is transported.

The printing medium is not limited to the printing paper S, and may be a resin film, a resin sheet, a metal sheet, and the like.

Although the ink jet method is adopted as a printing method, the method is not limited to this, and an arbitrary method such as electrophotographic method or a thermal transfer method may be adopted. Further, the printing apparatus is not limited to the printer, and may be embodied as a FAX apparatus, a copy apparatus, or a multi function peripheral which has multiple functions of these. Moreover, even in the ink jet method, the liquid ejecting apparatus, which ejects or discharge liquid other than ink, may be employed. The ink jet method can be applied to various liquid ejecting apparatuses having the liquid ejecting head for discharging infinitesimally small amounts of liquid droplets. Furthermore, the liquid droplets mean a state of the liquid discharged from the liquid ejecting apparatus, that is, liquid droplets is defined to include droplets having a granular shape, a tear shape, and a thread shape as a trailing shape. Further, the liquid described herein may be any material if only the material is able to be ejected by the liquid ejecting apparatus. For example, any material in a liquid state may be used, and the material may include liquid substance having high or low viscosity, sol, gel water, other inorganic solvents, organic solvents, solution, liquid resin, and fluid like liquid metal (metallic melt). Further, the material may include not only liquid, which is one state of substance, but also the material in which particles of a functional material formed of solids such as pigments and metallic particles are dissolved, distributed, or mixed in a solvent. Further, representative examples of the liquid include the ink as described in the embodiment and a liquid crystal. Here, the ink is defined to include various liquid composites such as general water-based and oil-based inks, a gel ink, and a hot-melt ink. The detailed examples of the liquid ejecting apparatus include a liquid ejecting apparatus for ejecting liquids including materials, in a distributed or dissolved form, such as color materials and electrode materials used for production of a liquid crystal display, an EL (electroluminescence) display, a surface-emitting display, and a color filter; a liquid ejecting apparatus for ejecting bio organic materials used in bio chip production; a liquid ejecting apparatus, which is used as a precision pipette, for ejecting liquids as specimens; a textile printing apparatus; and a micro dispenser. Moreover, it may be possible to employ a liquid ejecting apparatus for ejecting lubricating oil to precision instruments such as a clock and a camera by using a pinpoint method; a liquid ejecting apparatus for ejecting transparent resin liquid such as ultraviolet curable resin on a substrate in order to form a micro hemispherical lens (optical lens) used in an optical communication element; and a liquid ejecting apparatus for ejecting etching liquid such as acid or alkali in order to perform an etching on a substrate and the like. The invention may be applied to any one of the liquid ejecting apparatuses and the liquid containers.

The entire disclosure of Japanese Patent Application No. 2010-205746, filed Sep. 14, 2010 is expressly incorporated by reference herein.

What is claimed is:

1. A printing apparatus comprising:

a transporting unit configured to transport an elongated printing medium along a transport path;

a printing unit configured to perform a printing process on the printing medium, which is transported forward from an upstream side to a downstream side by the transporting unit, at a print position in the transport path;

a cutting unit configured to cut the printing medium at a cutting position on the downstream side of the print position so as to divide a part of the printing medium, on which the printing process is performed; and a removing unit configured to remove cutting dust, at a removal position on the downstream side of the print position, wherein the printing unit performs the printing process on a non-printed part thereof from which the cutting dust is removed through the removing unit by transporting the printing medium backward to the print position, and wherein the removing unit includes a pair of pinching members, wherein at least one of the pinching members comprises a porous material that captures the cutting dust inside the pores of the porous material, and one of the pair of pinching members is selectively biased toward the other of the pair of pinching members to selectively contact the elongated printing medium following cutting of the printing medium at the cutting position, wherein the removal position is on the downstream side of the cutting position.

2. The printing apparatus according to claim 1, wherein the pair of pinching members pinch the non-printed part at the removal position when the printing medium is transported backward to the upstream side by the transporting unit such that the printing process is performed on the non-printed part of the printing medium which is cut by the cutting unit.

3. The printing apparatus according to claim 2, wherein the pair of pinching members pinch the non-printed part in a state where at least one of the pinching members is elastically deformed.

4. The printing apparatus according to claim 2, wherein the removing unit includes a driving section that displaces at least one of the pair of pinching members such that it approaches or separates from the non-printed part.

5. The printing apparatus according to claim 2, wherein the cutting unit sequentially cuts the printing medium from one end thereof toward the other end, and wherein the pair of pinching members are provided to be able to pinch at least the other end of the printing medium.

6. The printing apparatus according to claim 2, wherein the pair of pinching members are a pair of transport rollers constituting a part of the transporting unit.

7. The printing apparatus according to claim 6, wherein the removing unit has a rotation control section that controls rotation of at least one of the pair of transport rollers when the cutting dust is removed by transporting the printing medium backward in a state where the non-printed part is pinched by the pair of transport rollers.

8. The printing apparatus according to claim 1, wherein the removing unit includes a driving section that displaces the removing unit so that the removing section separates from the non-printed part so that the non-printed part can pass through the removing unit and so that the removing section approaches the non-printed part when removing the cutting dust.

9. A printing method for a printing apparatus comprising:

performing a printing process on an elongated printing medium at a print position in a transport path by transporting the printing medium forward from an upstream side to a downstream side along the transport path;

dividing a part of the printing medium by cutting the printing medium at a cutting position on the downstream side of the print position;

transporting the printing medium backward to the print position, after removing cutting dust, at a removal position on the downstream side of the print position, the cutting dust being removed by a removing unit that includes a pair of pinching members, wherein at least one of the pinching members comprises a porous material that captures the cutting dust inside the pores of the porous material, one of the pair of pinching members is selectively biased toward the other of the pair of pinching members to selectively contact the elongated printing medium following cutting of the printing medium at the cutting position, wherein the removal position is on the downstream side of the cutting position; and performing a printing process on a non-printed part of the printing medium which is transported backward to the print position.

10. The printing method for the printing apparatus according to claim 9, wherein in the backward transporting of the printing medium, the printing medium is transported backward to the print position in a state where the non-printed part of the printing medium is pinched at the removal position by using a pair of pinching members.

11. The printing apparatus according to claim 9, wherein the removing unit includes a driving section that displaces the removing unit so that the removing section separates from the non-printed part so that the non-printed part can pass through the removing unit and so that the removing section approaches the non-printed part when removing the cutting dust.

* * * * *